United States Patent [19]

Uchida et al.

[11] 4,325,277

[45] Apr. 20, 1982

[54] DISPENSER FOR MAKING PAYMENT OF PRE-PACKED PAPER SHEETS

[75] Inventors: Isamu Uchida; Eiichi Kokubo; Toshinobu Sasaki, all of Tokyo, Japan

[73] Assignee: Laurel Bank Machine Co., Ltd., Tokyo, Japan

[21] Appl. No.: 152,191

[22] Filed: May 22, 1980

[30] Foreign Application Priority Data

May 25, 1979 [JP] Japan ..... 54-64656

[51] Int. Cl.[3] ..... G07F 11/68

[52] U.S. Cl. ..... 83/205; 83/278; 83/423; 83/648; 221/197

[58] Field of Search ..... 83/203, 204, 205, 242, 83/243, 278, 423, 648, 649; 221/30, 71–75, 197, 198; 194/4C

[56] References Cited

U.S. PATENT DOCUMENTS

| | | | |
|---|---|---|---|
| 3,310,199 | 3/1967 | Roberts et al. | 221/197 X |
| 3,341,066 | 9/1967 | Bowes | 221/72 X |
| 3,635,321 | 1/1972 | Frazier | 194/4 C |
| 3,917,045 | 11/1975 | Williams et al. | 221/71 X |
| 3,995,768 | 12/1976 | Montalbano | 221/197 |

*Primary Examiner*—James M. Meister

*Attorney, Agent, or Firm*—Fleit & Jacobson

[57] ABSTRACT

There is provided a compact and simple dispenser for dispensing envelopes each containing a predetermined number of paper sheets such as bank notes and being positively guided by perforations formed at the marginal side or sides of the envelopes. A series of envelopes is housed and stocked in a container unit of the dispenser while being folded one on another to form a train of envelopes which are cut off along the folded lines and then dispensed individually under the control of the central control center. The dispenser of the invention comprises the container unit which has a lock, and a dispensing unit having a cavity for receiving the container unit and a locking device for releasingly locking the lock of the container unit until a signal instructing disassembly of the container unit from the dispensing unit is received. The dispensing unit is further provided with a gearing mechanism to be coupled with the positive feeding mechanism of the container unit to drive the latter so that a single envelope is conveyed and fed to the dispensing unit.

5 Claims, 7 Drawing Figures

DISPENSER FOR MAKING PAYMENT OF PRE-PACKED PAPER SHEETS

BACKGROUND OF THE INVENTION:

1. Field of the Invention

The present invention relates to a dispenser for automatically making payment of a predetermined number of pre-packed paper sheets, such as bank notes, postage stamps, cards etc., and more particularly the object thereof is to provide a bank note dispenser which is simple and compact in construction and inexpensive to be adapted for prevalent uses.

2. Prior Art

In the conventional bank note dispenser, the bank notes stacked in order are sucked one at a time by means of vacuum to be conveyed to a discharge port. The bank notes are subject to various inspections in the course of conveyance and those which have no abnormality are paid from the dispenser. However, the conventional bank note dispenser has a disadvantage in that the dispensing device and the conveying device assembled in the system are considerably complicated to result in redundant increase in dimensions of the entire dispenser system.

The conventional bank note dispenser has an additional disadvantage in that upon payment of used bank notes having creases or rimples they tend to be jammed frequently in the course of conveyance and the bank notes thus jammed cannot be removed smoothly since the construction of the dispenser system is complicated.

Moreover, the conventional dispenser is too intricate and expensive to be used for wide applications.

For the reasons described above, the conventional bank note dispensers have been installed only at extremely limited places, for example in the banks and large stations. It is inconvenient for the customers to go out of their shopping way to go to such limited places in order to draw cashes from their deposits in case where it becomes necessary to pay in cash.

SUMMARY OF THE INVENTION

The object of the present invention is to provide a compact and simple bank note dispenser which can be conveniently installed at any shops including department stores and supermarkets. The dispenser according to the present invention has a dispensing device for dispensing envelopes each containing a predetermined number of bank notes. Each of the envelopes is provided with perforations by which the envelope is guided and paid from the dispenser. Thus, the dispensing device can be simplified and various inspection devices for inspecting the bank notes are not necessarily assembled in the system. As a result, the dimensions of the entire dispenser system can be decreased and the cost thereof is minimized to be used at various places.

DESCRIPTION OF THE DRAWINGS

The above and other objects and advantages of the invention will become apparent from the following detailed description of the invention with reference to the appended drawings showing a preferred embodiment of the automatic dispenser of the invention wherein.

DETAILED DESCRIPTION OF THE PREFERRED EMBODIMENT OF THE INVENTION

Figure 1:
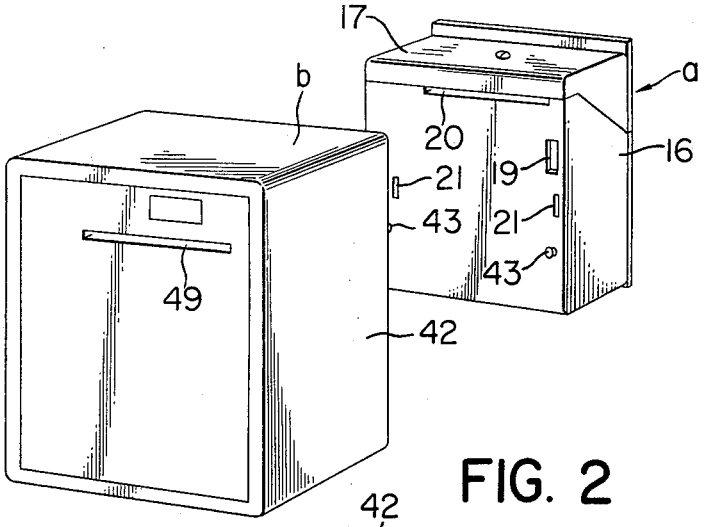
FIG. 1 is a perspective view of one embodiment of the automatic dispenser according to the invention showing the outer contours of the container for the bank notes and the dispensing device which are disassembled from each other.
Figure 2:
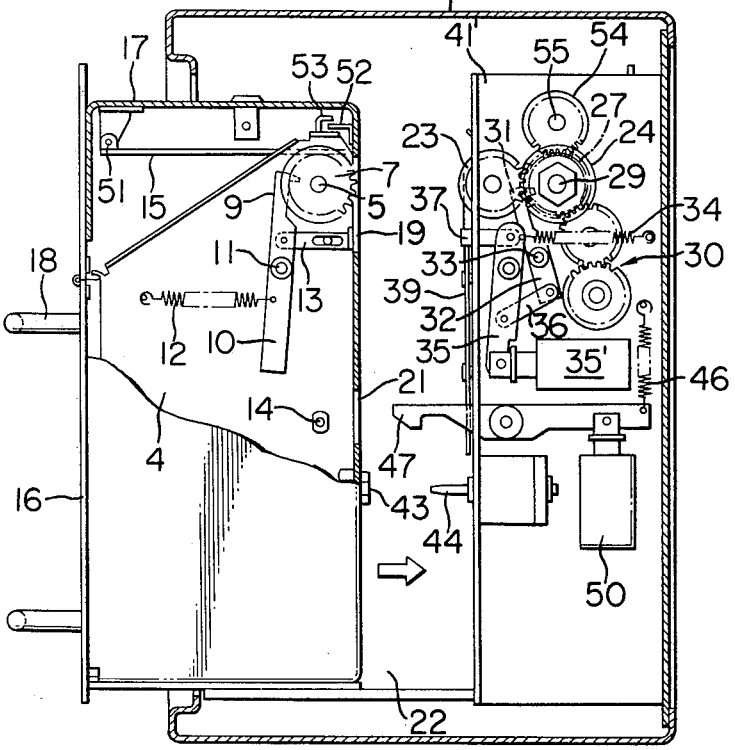
FIG. 2 is a diagrammatical side elevation, with the housings being cut away, showing the container and the dispensing device which are just being assembled.
Figure 3:
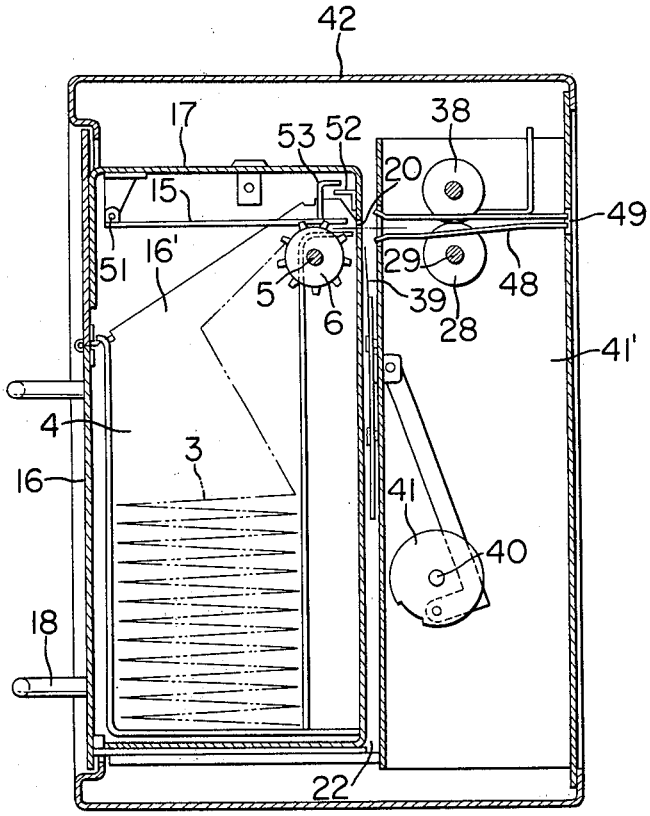
FIG. 3 is a diagrammatical side elevation, with the parts being cut away, showing the container and the dispensing device after being assembled.

Referring first to FIG. 1, the automatic dispenser according to the present invention comprises a container a for the bank notes and a dispensing device b. The container a and the dispensing device b are constructed as separated units and may be coupled together to form a combined automatic dispenser.

As will be seen from FIGS. 2 to 5, the container a has a container section 4 in which a train of sealed envelopes 3 is stocked while being folded and laid one on another. Each envelope 3 contains a predetermined number of bank notes 1 at a constant pitch and is provided with perforations 2 at the marginal sides. It is preferred that the envelope is made of a transparent material or alternatively it has a transparent window portion. The perforations 3 receive the teeth of two sprocket wheels 6 mounted on a shaft 5. On the same shaft 5 mounted are a gear 7 and a stopper wheel 8. The stopper wheel 8 is stopped at the preset angular position as it is locked by a pawl 9 of a lever 10 which is swingably mounted on a shaft 11. The lever 10 is normally urged by a spring 12 so that the pawl 9 locks the stopper wheel 8 at the preset position. An operating rod 13 is connected to the lever 10 to swing the lever 10 so that the pawl 9 releases the stopper wheel 8. Reference numeral 14 designates a lock pin and numeral 15 designates a weight plate. All of the aforementioned parts are housed in a housing 16 having a lid 17 which may be opened by releasing the lock by means of a key and again closed and locked to prevent access to the container section by an unauthorized person. The housing 16 is also provided with handles 18 on the rear side thereof. On the front side of the housing 16, there are formed an opening 19 for exposing the teeth of the gear 7 to be meshed with a corresponding gearing of the dispensing device, a discharge slit or port 20 through which the envelopes are passed to the dispensing device and opening 21 through which lock levers extend to engage with the lock pins 14 as will be described in detail hereinafter. The weight plate 15 has one end swingably supported by fulcrum 51 and other end formed with a hook 53 which engages with a holder member 52 fixedly secured to the lid 17 when the lid 17 is opened. Reference numeral 16' designates a support plate. The dispensing device b has a cavity 22 in which the container a for the bank notes is received. The dispensing device b is provided with an interposed gear 23 for providing to mesh with the gear 7 of the container a.

The gear 23 is also meshed with a link gear 24 which is fixedly connected to a stopper wheel 25 and loosely mounted on a shaft 29. The link gear 24 and the stopper wheel 25 may be connected to and disconnected from a driving gear 27 by means of a clutch 26 fixedly mounted on the shaft 29. Conveyer rollers 28 are fixedly mounted on the same shaft 29. The driving gear 27 is rotated through a transmission gear or gears 30 by a driving motor (not shown).

A lever 32 having a pawl 31 for releasingly locking said stopper wheel 25 at a preset angular position is mounted on a shaft 33 while being biased normally by a spring 34 so that the pawl 31 locks the wheel 25. However, the lever 32 may be swung to release the locking by the pawl 31 to allow the wheel 25 to rotate when a magnet 35' is energized to swing a magnet lever 35 which is connected to the lever 32 through a link lever 36. As shown, the end of the magnet lever 35 other than the one connected to the magnet 35' is provided with a push lever 37 which extends through the housing 16 of the container a to abut against the operating rod 13 when the container a and the dispensing device b are assembled together. Reference numeral 38 designates contact rollers engaging with the conveying rollers 28. The contact rollers 38 are mounted on a shaft 55 which is rotated by a gear 54 meshing with said driving gear 27.

Figure 4:
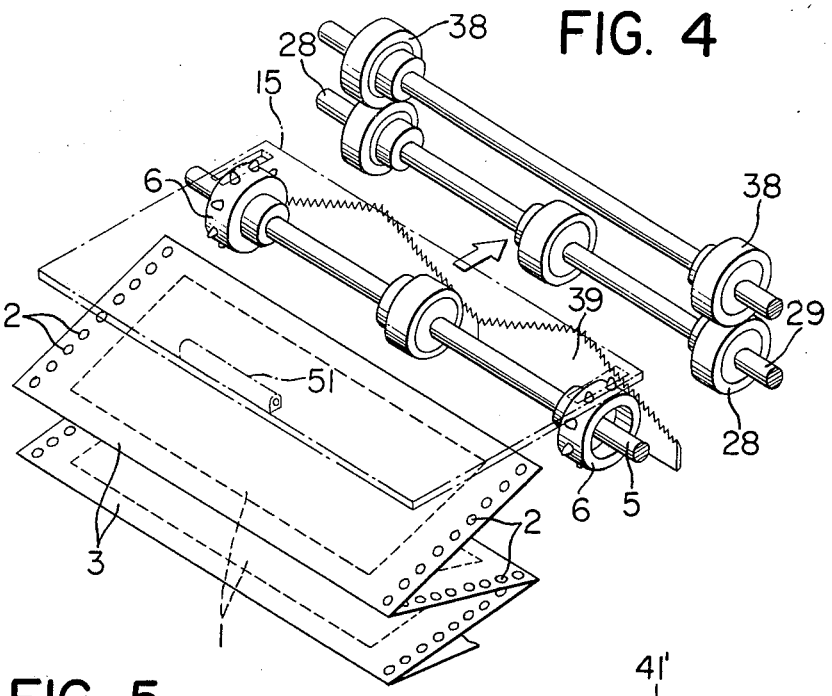
FIG. 4 is a perspective view showing a portion of the dispensing mechanism.
Figure 5:
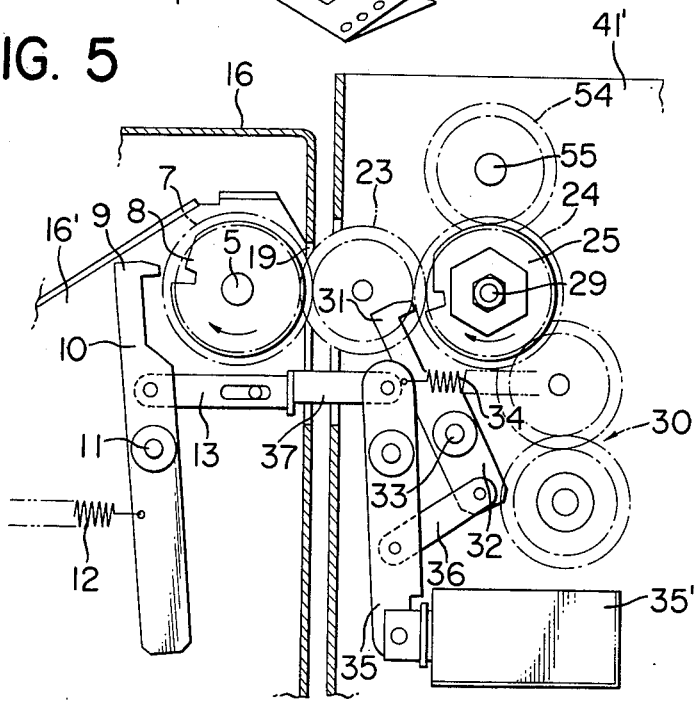
FIG. 5 is a fragmentary side elevation diagrammatically showing the operation of the dispensing mechanism.
Figure 6:
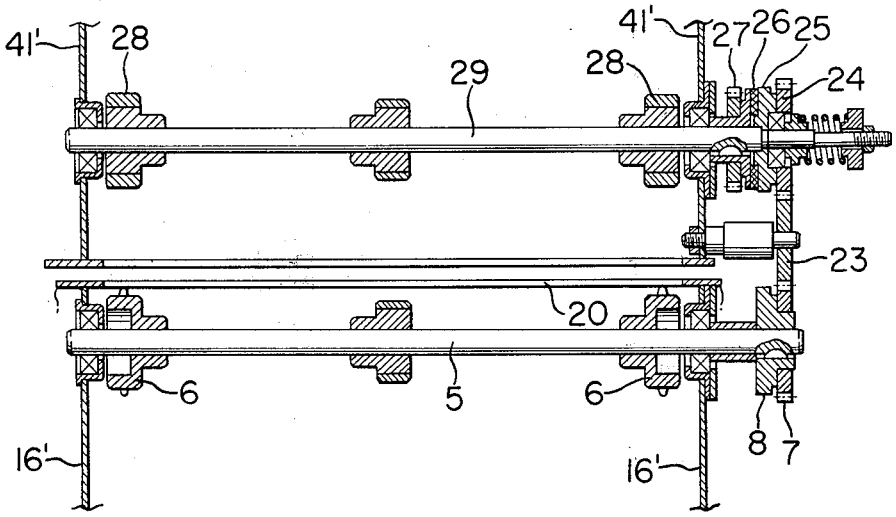
FIG. 6 is a sectional view showing the gearing mechanism.
Figure 7:
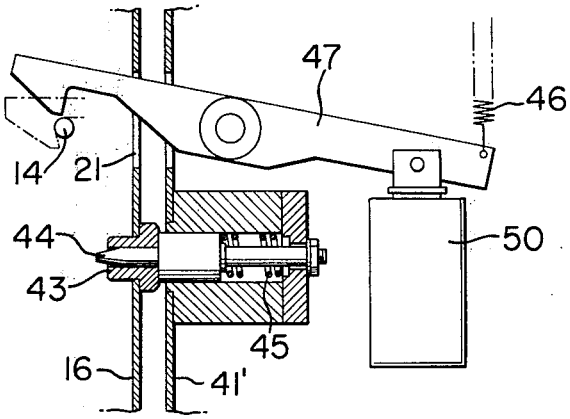
FIG. 7 is a fragmentary section showing the coupling for assembly.

A cutter 39 is provided at the side of the dispensing device b opposing to the front side of the container a. The cutter 39 is connected to an eccentric disc 41 mounted on a shaft 40. In order to decrease the stroke of the sliding movement of the cutter 39, it is preferred that the cutter has a plurality of teeth as shown in FIG. 4. All of the aforementioned parts are supported by a support member 41' and housed in an outer housing 42 within which said cavity 22 is formed.

When using the dispenser of the present invention, the container a is disassembled from the system and the lid 17 is opened by unlocking the locking mechanism by the key. Then, a train of envelopes 3 is charged in the container section in the folded condition. In order to facilitate the folding operation, it is preferred that creases or roulettes are provided at the boundary portions between respective envelopes. The perforations 2 at the leading end of the envelope 3 are meshed with the teeth of the sprockets 6 and the lid 17 is closed. Upon closure of the lid 17, the meshing portion of the envelope 3 is pressed by the weight plate 15 to prevent the perforations from being released from the teeth. The lid is locked and the container a is inserted in the cavity 22 of the dispensing device b. Pin receivers 43 receive pins 44 and then compress springs 45, and the lock levers 47 biased by springs 46 are engaged with the lock pins 14. At the same time, the gear 7 meshes with the interposed gear 23. Consequently, the container a is set. When a card is inserted by a customer into a card signal reader, not shown, attached to the cash dispenser of the invention, the signals read out by the reader are transferred to the computer center through the computer of the bank or the data telephone system attached to the cash dispenser to check whether the condition for payment, such as the amount of money on deposit, is satisfied or not. If a signal instructing the payment is received, the magnet 35' is energized to release or unlock pawls 9 and 31 from the stopper wheels 8 and 25, respectively, through the magnet lever 35, the push lever 37, operating rod 13 and lever 10 and through the link lever 36 and the lever 32. Concurrently, the driving motor (not shown) is actuated to rotate the transmission gears 30, the driving gear 27, the interposed gear 23 and the gear 7, whereby the envelope 3 is moved by the preset pitch, for example one pitch, and the leading end of the first envelope 3 is guided by the sprockets 6 to be positioned in-between the conveying rollers 28 and the contact rollers 38. After each of the sprockets 6 is rotated by a preset angle, the magnet 35' is deenergized to allow the pawls 9 and 31 to stop the stopper wheels 8 and 25 at the preset positions by the action of the springs 12 and 34. At the same time, by means of a detector switch (not shown) for detecting the engagement of the stopper wheel 25 with the pawl 31 of the lever 32, the driving motor is stopped to rotate.

Upon completion of the one pitch feeding of the envelope 3, the shaft 40 is revolved to rotate the eccentric disc 41 to strike the cutter 39 into the folded line of the envelope 3 to cut the latter. After the envelope is cut off and the cutter 39 is retracted to the initial position, the driving motor is again energized to rotate. However, at this stage, the magnet 35' is not energized so that the stopper wheels 8 and 25 are locked by the pawls 9 and 31 at their preset angular positions. Under such condition, the driving gear 27 which is directly meshed with the transmission gears 30 is rotated but the link gear 24 is not rotated since it is disconnected from the clutch 26. As the result, only the conveying rollers 28 and the contact rollers 38 are rotated to convey the cut-off envelope 3 to a dispensing port 49 formed on the outer housing 42 along guide means 48. The amount of money contained in the dispensed envelope 3 may be visually inspected through the transparent portion of the envelope.

If it is desired to draw out the container a from the dispensing device b, the unlocking magnet 50 is energized by a signal fed from the outside of the dispenser, e.g. generated and fed from the central control system of the computer center, to swing the lock lever 47 against the biasing force of the spring 46 to release the locking coupling. Upon release of the locking coupling of the lock levers 47 and the lock pins 14, the pins 44 are pushed out of the pin receivers 43 by the action of the accumulated repulsion forces of the springs 45, whereby the container a is disassembled from the dispensing device b to move the position at which the lock pins 14 are unlocked from the lock levers 47. Thereafter, the container a may be drawn out of the cavity of the dispensing device b by hand.

Since it is requisite to feed a signal from the central control system for disassembling the container a from the cash dispenser b of the present invention, the cash in the container can be stocked under more reliable condition when compared to the apparatus wherein the disassembly of the cash container is performed by the use of a key. According to the present invention more accurate and simple operation can be assured, since envelopes containing a predetermined number of bank notes are successively dispensed under the instruction of the central control center and the individual dispensing operation is effected by the positive perforation system. The automatic dispenser according to the invention is extremely simplified in construction since various inspection devices for inspecting the bank notes are not necessarily assembled in the system. Thus, the dimensions of the entire dispenser system is decreased and the weight thereof is also reduced, and further the cost thereof is minimized to be used at various places.

What is claimed is:

1. A dispenser for making payment of pre-packed paper sheet comprising:

container unit means including a container section for stocking a continuous train of sealed envelopes enclosing a predetermined number of sheets in the folded condition, said envelopes being provided with perforations at at least one marginal side portion, shifting means for meshing with said perforations and means for locating the train of the envelopes by a preset pitch; and dispensing unit means having a cavity for receiving said container unit means and including means for actuating said locating means of the container unit means, conveyor means operable to receive and convey said train of envelopes by said preset pitch, and cutter means for cutting off a leading envelope from said train along the folded line.

2. A dispenser according to claim 1, wherein said shifting means comprises a sprocket having teeth for meshing with the perforations of individual envelopes.

3. A dispenser according to claim 1 or 2, wherein said dispensing unit has a gearing mechanism for driving said shifting means of said container unit means and said conveying means of said dispensing unit means in synchronism with each other.

4. A dispenser according to claim 1 or 2, wherein said container unit means further includes a stop pin and said dispensing means further includes a lock lever for engaging said stop pin to lock said container unit means within said dispensing unit means.

5. A dispenser according to claim 4, wherein said lock lever is caused to be separated from said stop pin when said container unit means is removed out of said dispensing unit means.

* * * * *